US007331151B2

(12) United States Patent
Kim

(10) Patent No.: US 7,331,151 B2
(45) Date of Patent: Feb. 19, 2008

(54) MEDICINE PACKAGING MACHINE HAVING DRIVING SETTING DEVICE

(75) Inventor: Jun-ho Kim, Daegu (KR)

(73) Assignee: JVM Co., Ltd., Daegu (KR)

( * ) Notice: Subject to any disclaimer, the term of this patent is extended or adjusted under 35 U.S.C. 154(b) by 0 days.

(21) Appl. No.: 11/618,219

(22) Filed: Dec. 29, 2006

(65) Prior Publication Data

US 2007/0151204 A1 Jul. 5, 2007

Related U.S. Application Data

(63) Continuation-in-part of application No. 10/942,922, filed on Sep. 17, 2004, now abandoned.

(30) Foreign Application Priority Data

Sep. 18, 2003 (KR) ..... 10-2003-0064825

(51) Int. Cl.
*B65B 57/10* (2006.01)

(52) U.S. Cl. ..... 53/52; 53/131.4; 53/55

(58) Field of Classification Search ..... 53/52
See application file for complete search history.

(56) References Cited

U.S. PATENT DOCUMENTS 5,444,749 A 8/1995 Nambu
5,671,592 A * 9/1997 Yuyama et al. ..... 53/493
5,678,393 A 10/1997 Yuyama et al.
5,875,610 A 3/1999 Yuyama et al.
6,385,943 B2 5/2002 Yuyama et al.
6,397,558 B1 * 6/2002 Yuyama et al. ..... 53/131.4
6,497,083 B1 12/2002 Garwood et al.
6,581,798 B2 6/2003 Liff et al.
6,792,736 B1 * 9/2004 Takahashi et al. ..... 53/237

* cited by examiner

*Primary Examiner*—John Sipos
(74) *Attorney, Agent, or Firm*—Oblon, Spivak, McClelland, Maier & Neustadt, P.C.

(57) ABSTRACT

An automatic medicine packaging machine having a driving setting device for conveniently setting driving values and delay times of driving devices is disclosed. The driving setting device includes a touch screen to display a user operating program and to receive manipulation commands from a user, a memory to store the user operation program, a communication unit to transmit and receive data to and from the main controller, and a sub-controlling unit to control operation of the driving setting device according to the user operating program stored in the memory. The sub-controlling unit includes an interface supplying unit to supply a user interface, a driving value setting unit to receive driving values of the medicine packaging machine, a delay time setting unit to set the delay times of the medicine packaging machine, and a setting value transmission unit to transmit the values set by the setting units to the main controller.

9 Claims, 7 Drawing Sheets

5 0

5 1

MEDICINE PACKAGING MACHINE HAVING DRIVING SETTING DEVICE

BACKGROUND OF THE INVENTION

1. Field of the Invention

The present invention relates to an automatic medicine packaging machine for automatically packaging tablets by a dose, and more particularly, to an automatic medicine packaging machine having a driving setting device for conveniently setting driving values and delay times of respective driving devices and for easily changing the driving values and the delay times.

2. Description of the Related Art

In general, an automatic medicine packaging machine is an apparatus to automatically and continuously package pills dispensed by doses.

Such the conventional automatic medicine packaging machine is schematically illustrated in FIG. 7 and its structure and operation will be described as follows.

The conventional automatic medicine packaging machine includes a medicine supply 100, having a tablet cassette 101 and a manual dispensing tray 102, to supply medicines, a hopper 200 having a shutter 201 disposed in the lower side thereof to be opened and closed, a sealer 300 driven by a main motor 301 to seal a medicine packaging sheet in which the tablets are accommodated, a printer 400 to print the dosage schedule on the medicine packaging sheet fed to the sealer 300, a cutter 500 to cut the sealed medicine packaging sheet in which the tablets are accommodated, a hitting stick 600 to hit the medicine packaging sheet that is doubled, and a main controller 700 to control the respective driving devices of the automatic medicine packaging machine, and a storage to store data.

In the above constructed conventional automatic medicine packaging machine, the tablets are discharged by doses from the tablet cassette 101 in which the tablets are accommodated and the manual dispensing tray 102 from which the tablets are manually dispensed by a pharmacist to the hopper 200 to collect the discharged tablets, the tablets collected by doses in the hopper 200 drop from the hopper 200 by the operation of the shutter 201 all at once and are accommodated in the doubled medicine packaging sheets.

The tablets accommodated in the medicine packaging sheets are transferred to the sealer 300 together with the medicine packaging sheets and are packaged by doses by which the medicine packaging sheets are welded by the sealer 300. At that time, the medicine packaging sheets pass through the printer 400 so that the usage schedule for the tablets is printed on the front sides of the medicine packaging sheets.

The medicine packaging sheets, which are printed while passing through the printer 400, are doubled before entering the sealer 300, and the hitting stick 600 hits the insides of the doubled medicine packaging sheets so that the medicine packaging sheets are strained and enter the sealer 300.

The sealer 300 is associated with the main motor 301 to be rotated by the main motor 301 and seals the entering medicine packaging sheets by welding to package the tablets by doses continuously.

A series of the medicine packaging sheets is formed by continuously sealing and packaging the tablets by doses and the series of the medicine packets is cut by a predetermined length by the cutter 500.

The respective driving devices of the conventional automatic medicine packaging machine, namely, the manual dispensing tray 102, the shutter 201, the main motor 301, the printer 400, the cutter 500, and the hitting stick 600 are controlled by the main controller 700, and the storage 800 is a device to be connected to the main controller 700 to store data about medicine information and prescription information.

However, the conventional automatic medicine packaging machine had disadvantages as follows.

The respective driving devices of the conventional automatic medicine packaging machine, namely, the manual dispensing tray, the shutter, the sealer, the printer, the cutter, and the hitting stick must be individually adjusted to be driven by the user so that it is very inconvenient to set the driving of the respective driving devices.

The manual setting by the user causes inconvenience when changing and modifying the setting for the driving of the respective driving devices.

SUMMARY OF THE INVENTION

Therefore, the present invention has been made in view of the above and/or other problems, and it is an aspect of the present invention to provide an automatic medicine packaging machine having a driving setting device to conveniently set driving values and delay times of respective driving devices of the automatic medicine packaging machine and to easily change the driving values and the delay times.

It is another aspect of the present invention to provide an automatic medicine packaging machine having a driving setting device to display driving values and delay times that are completely set such that a user easily perceives and confirms the driving values and the delay times that are completely set.

It is another aspect of the present invention to provide an automatic medicine packaging machine having a driving setting device to easily acquire driving values and delay times set in the automatic medicine packaging machine even when the driving setting device is replaced.

It is still another aspect of the present invention to provide an automatic medicine packaging machine having a driving setting device with a user authentication device to prevent a person other than an authenticated user from using the driving setting device.

In accordance with the present invention, the above and other objects can be accomplished by the provision of an automatic medicine packaging machine comprising: a medicine supply including a manual dispensing tray to supply medicines; a hopper including a shutter disposed in a lower side of the hopper to be opened and closed; a sealer driven by a main motor to seal medicine packaging sheets in which tablets are accommodated; a printer to print usage schedules on the medicine packaging sheets to be fed to the sealer; a cutter to cut the sealed medicine packaging sheets in which the tablets are accommodated; a hitting stick to hit the medicine packaging sheets that are doubled; a main controller to control overall operation of respective driving devices of the automatic medicine packaging machine; a storage to store data; and a driving setting device to set driving values of the respective driving devices, the driving setting device comprising: a touch screen installed in a front side of the automatic medicine packaging machine to display a user operating program and to receive a manipulation command from a user; a memory in which the user operation program is stored; a communication unit to transmit and receive data to and from the main controller; and a sub-controlling unit to control overall operation of the driving setting device according to the user operating program stored in the memory and comprising an interface supplying unit to supply a user interface for a driving setting through the touch screen, a driving value setting unit to receive driving values of respective driving devices of the automatic medicine packaging machine through the touch screen and to set the driving values, a delay time setting unit to receive delay times of the main motor and the shutter through the touch screen and to set the delay times, and a setting value transmission unit to transmit the values set by the setting units to the main controller through the communication unit.

The sub-controlling unit further comprises a setting value display to display the driving values and the delay times set by the driving value setting unit and the delay time setting unit on the touch screen.

The sub-controlling unit further comprises a list transmission unit to make the setting values that are displayed by the setting value display according to the manipulation command inputted through the touch screen into a list and to transmit the list to the main controller.

The sub-controlling unit further comprises a list inquiring unit to request an inquiry for the list of the setting values to the main controller according to the manipulation commands inputted through the touch screen and to display the list of the setting values inquired by the main controller on the touch screen.

The sub-controlling unit further comprises a user authentication unit to authenticate a user for the driving setting device from authentication information inputted by the touch screen.

The user interface comprises: a user authentication window through which authentication information of the user for the driving setting device is inputted; a numerical value input window through which the setting values are inputted as numerical values; and a setting value displaying window to display the setting values inputted through the numerical value input window.

The setting value displaying window comprises: a driving value displaying window to display the driving values of the respective driving devices of the automatic medicine packaging machine; a delay time displaying window to display the delay time of the main motor; and a batch displaying window to display the values displayed by the driving value displaying window and the delay time displaying window all at once.

The driving value displaying window comprises: a main motor displaying window to display a driving value of the main motor; a cutter displaying window to display a driving value of the cutter; a manual tray displaying window to display a driving value of the manual dispensing tray; a printer displaying window to display a driving value of the printer; a shutter displaying window to display a driving value of the shutter; and a stick displaying window to display a driving value of the hitting stick.

The delay time displaying window comprises: a motor delay displaying window to display a delay time of the main motor; a shutter delay displaying window to display a delay time of the shutter; and a stick delay displaying window to display a delay time of the hitting stick.

BRIEF DESCRIPTION OF THE DRAWINGS

These and/or other aspects and advantages of the present invention will become apparent and more readily appreciated from the following description of the embodiments, taken in conjunction with the accompanying drawings, in which.

DESCRIPTION OF THE PREFERRED EMBODIMENTS

Hereinafter, an automatic medicine packaging machine having a driving setting device according to embodiments of the present invention will be described in detail with reference to the accompanying drawings.

Figure 1:
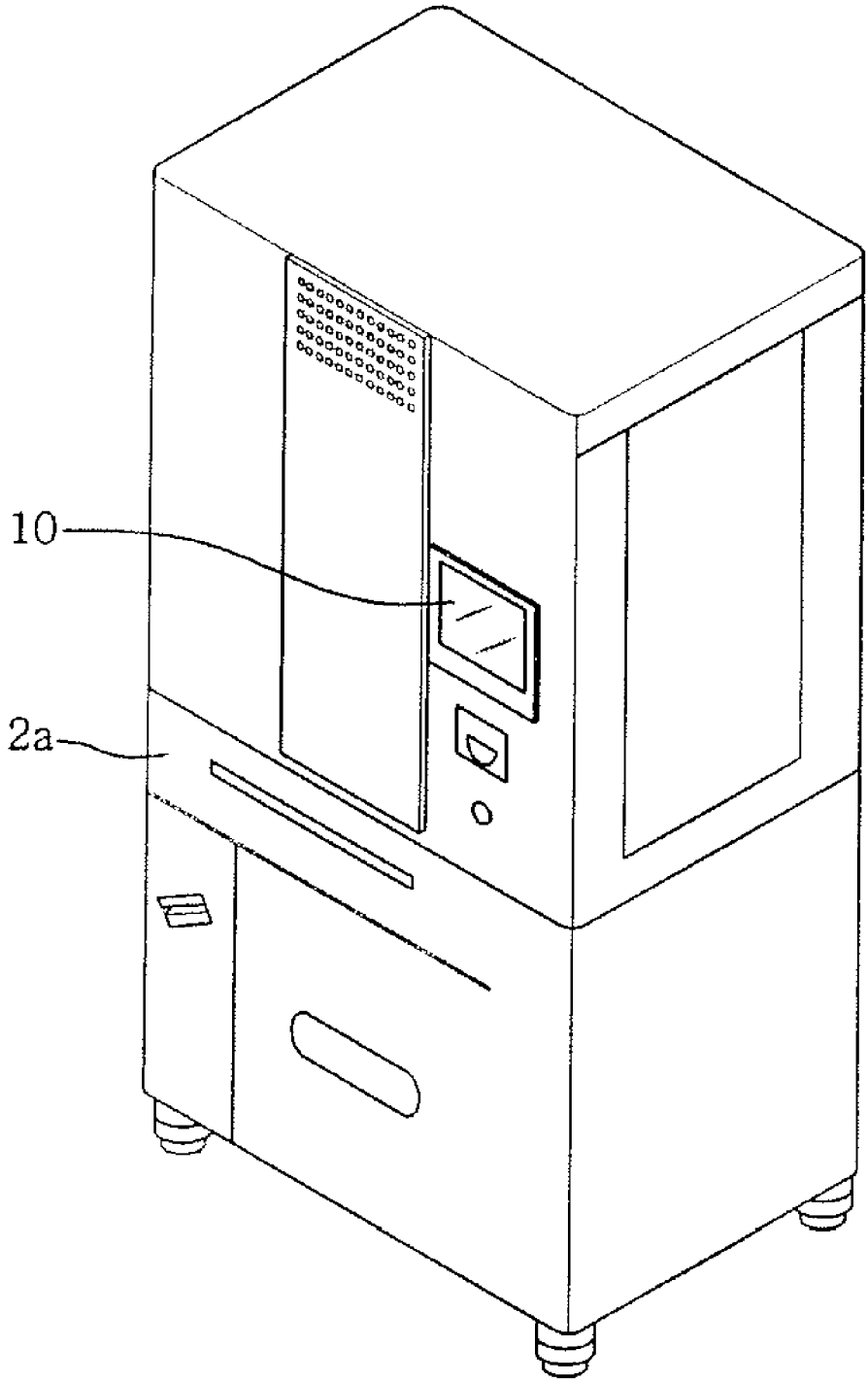
FIG. 1 is a perspective view illustrating an automatic medicine packaging machine according to an embodiment of the present invention.
Figure 2:
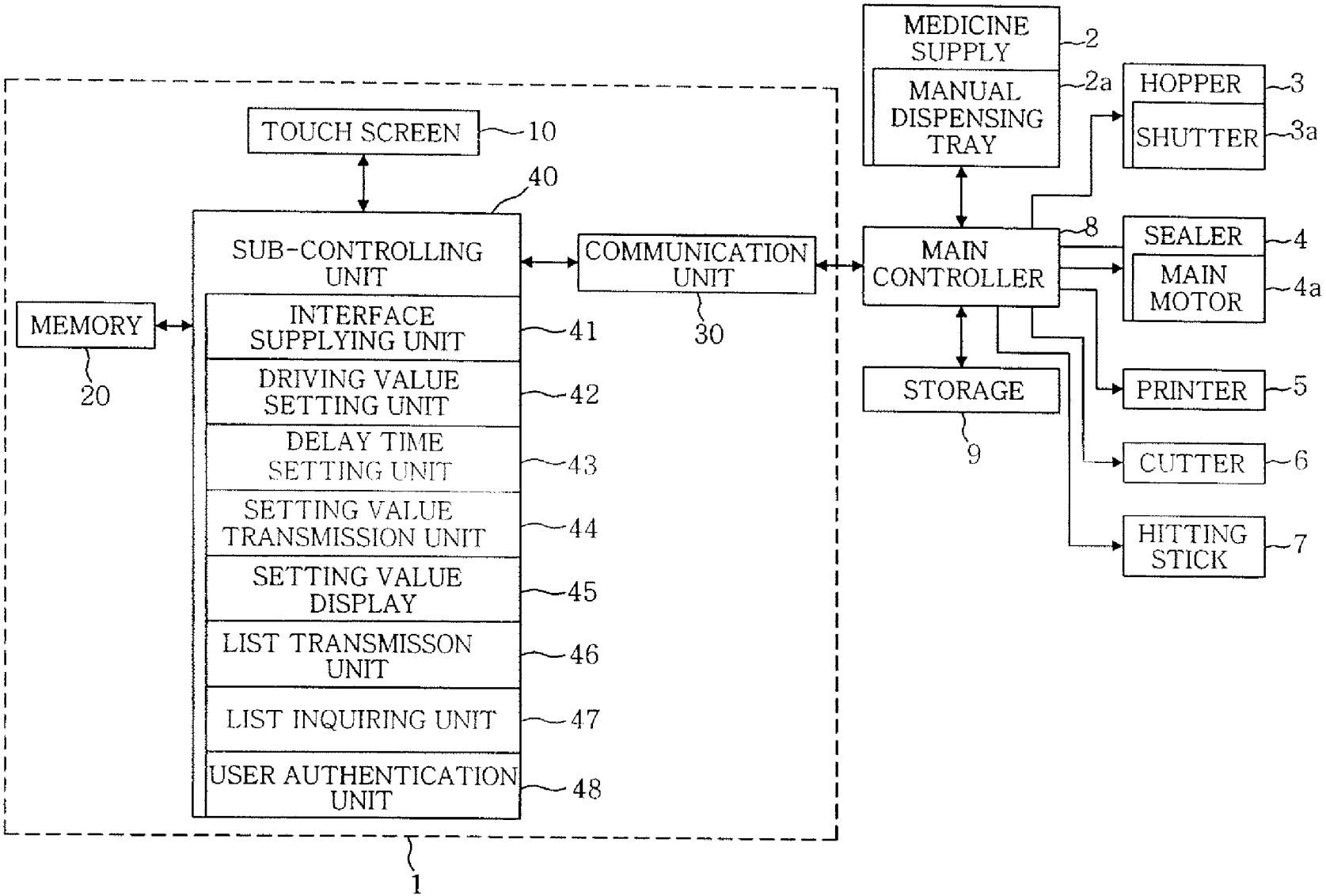
FIG. 2 is a block diagram illustrating the automatic medicine packaging machine according to the embodiment of the present invention.

FIG. 1 is a perspective view illustrating an automatic medicine packaging machine according to an embodiment of the present invention, and FIG. 2 is a block diagram illustrating the automatic medicine packaging machine according to the embodiment of the present invention.

As illustrated, the automatic medicine packaging machine includes a medicine supply 2 with a manual dispensing tray 2*a* to supply medicines, a hopper 3 having a shutter 3*a* disposed in the lower side thereof to be opened and closed, a sealer 4 driven by a main motor 4*a* to seal a medicine packaging sheet in which tablets are accommodated, a printer 5 to print usage schedule on the medicine packaging sheets to be fed to the sealer 4, a cutter 6 to cut the sealed medicine packaging sheets in which the tablets are accommodated, a hitting stick 7 to hit the medicine packaging sheets that are doubled, a main controller 8 to control overall operation of respective driving devices of the automatic medicine packaging machine, a storage 9 to store data, and a driving setting device 1 to set driving values of the respective driving devices.

The driving setting device 1 includes a touch screen 10 installed in a front side of the automatic medicine packaging machine, a memory 20 in which an operation program is stored, a communication unit 30 to transmit and receive data to and from the main controller 8, and a sub-controlling unit 40 to control overall operation of the driving setting device 1.

The touch screen 10 is installed in the front side of the automatic medicine packaging machine to display a user operating program and to receive a manipulation command from a user. Thus, the operating program is displayed such that the user perceives the operating program with the naked eye and inputs commands.

The memory 20 is connected to the sub-controlling unit 40 and stores the user operating program for the driving setting of the automatic medicine packaging machine.

The communication unit 30 transmits and receives data between the main controller 8 and the sub-controlling unit 40 to transmit the driving values set by the driving setting device 1 to the main controller 8 and to transmit data stored in the main controller 8 to the sub-controlling unit 40.

The sub-controlling unit 40 controls overall operation of the driving setting device 1 according to the user operating program stored in the memory 20 and includes an interface supplying unit 41 to supply a user interface, a driving value setting unit 42 to set the driving value of the automatic medicine packaging machine, a delay time setting unit 43 to set the delay time of the automatic medicine packaging machine, and a setting value transmission unit 44 to transmit the values set by the setting units 42 and 43 to the main controller 8.

The interface supplying unit 41 supplies the user interface for the driving setting to the touch screen 10 such that the user can easily perform the manipulation for the input and the change of the driving values.

The driving value setting unit 42 receives the driving values of the respective driving devices of the automatic medicine packaging machine through the touch screen 10 to set the received driving values such that the user inputs the driving values of the respective driving device of the automatic medicine packaging machine, namely, initial reference values for driving the respective driving devices so that the driving value setting unit 42 sets the driving values.

The delay time setting unit 43 receives the delay times of the main motor 4*a*, the shutter 3*a*, and the hitting stick 7 through the touch screen 10 to set the same and sets the delay times of the main motor 4*a*, the shutter 3*a*, and the hitting stick 7 when the user inputs the delay times of the main motor 4*a*, the shutter 3*a*, and the hitting stick 7 through the touch screen 10.

The setting value transmission unit 44 transmits the values set by the driving value setting unit 42 and the delay time setting unit 43 according to the manipulation commands inputted through the touch screen 10 by the user to the main controller 8 through the communication unit 30 such that, when the user manipulates the touch screen 10 to transmit the values set by the setting units 42 and 43 to the main controller 8 of the automatic medicine packaging machine, the main controller 8 determines reference positions of the respective driving devices for the driving of the respective driving devices of the automatic medicine packaging machine based on the transmitted driving values and thus the automatic medicine packaging machine is completely ready to operate.

The sub-controlling unit 40 further includes a setting value display 45 to display the driving values and the delay times set by the driving value setting unit 42 and the delay time setting unit 43 on the touch screen 10 all at once.

The setting value display 45 displays the driving values and the delay times set by the user on the touch screen 10 all at once so that the user can easily perceive the driving values and the delay times that are completely set at a glance.

The sub-controlling unit 40 further includes a list transmission unit 46 to make the setting values that are displayed by the setting value display 45 according to the manipulation command inputted through the touch screen 10 into a list and to transmit the list to the main controller 8.

The list transmission unit 46 transmits the list of the setting values to the main controller 8 such that the main controller 8 controls the storage 9 to store the list and thus the user can easily confirm a current status of the driving setting of the automatic medicine packaging machine through the data stored in the storage 9.

The sub-controlling unit 40 further includes a list inquiring unit 47 to request an inquiry for the list of the setting values to the main controller 8 according to the manipulation commands inputted through the touch screen 10 and to display the list of the setting values inquired by the main controller 8 on the touch screen 10.

The list inquiring unit 47 inquires the list of the setting values stored in the storage 9 so that the user can easily perceive the current status of the driving setting of the automatic medicine packaging machine through the touch screen when the driving setting device 1 is replaced.

The sub-controlling unit 40 further includes a user authentication unit 48 to authenticate a user for the driving setting device 1 from authentication information inputted by the touch screen 10. The user authentication unit 48 prevents a person other than the authenticated user from operating the driving setting device 1.

Figure 3:
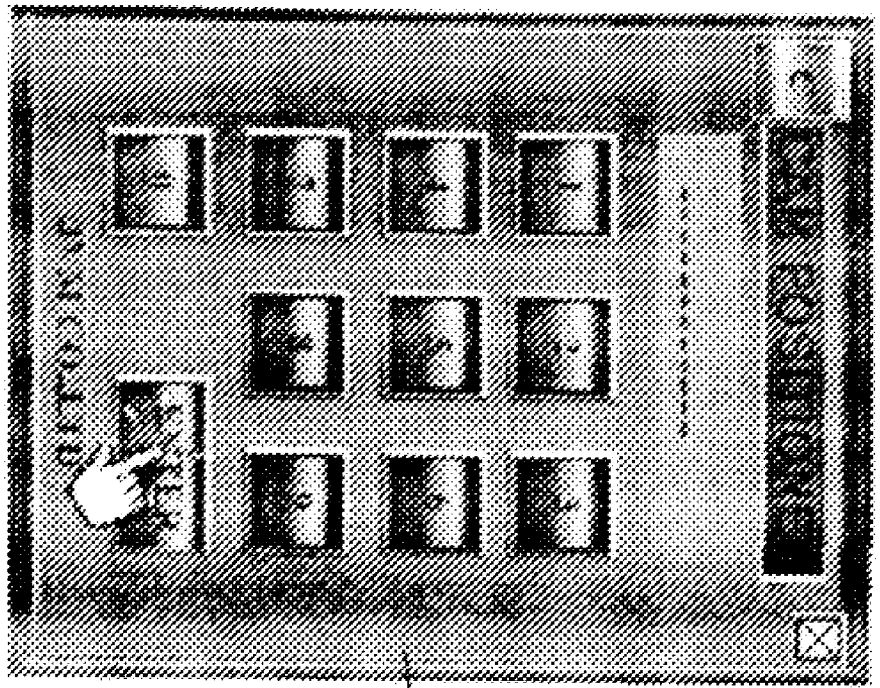
FIG. 3 is a view illustrating a user authentication window of the automatic medicine packaging machine according to the embodiment of the present invention.
Figure 4:
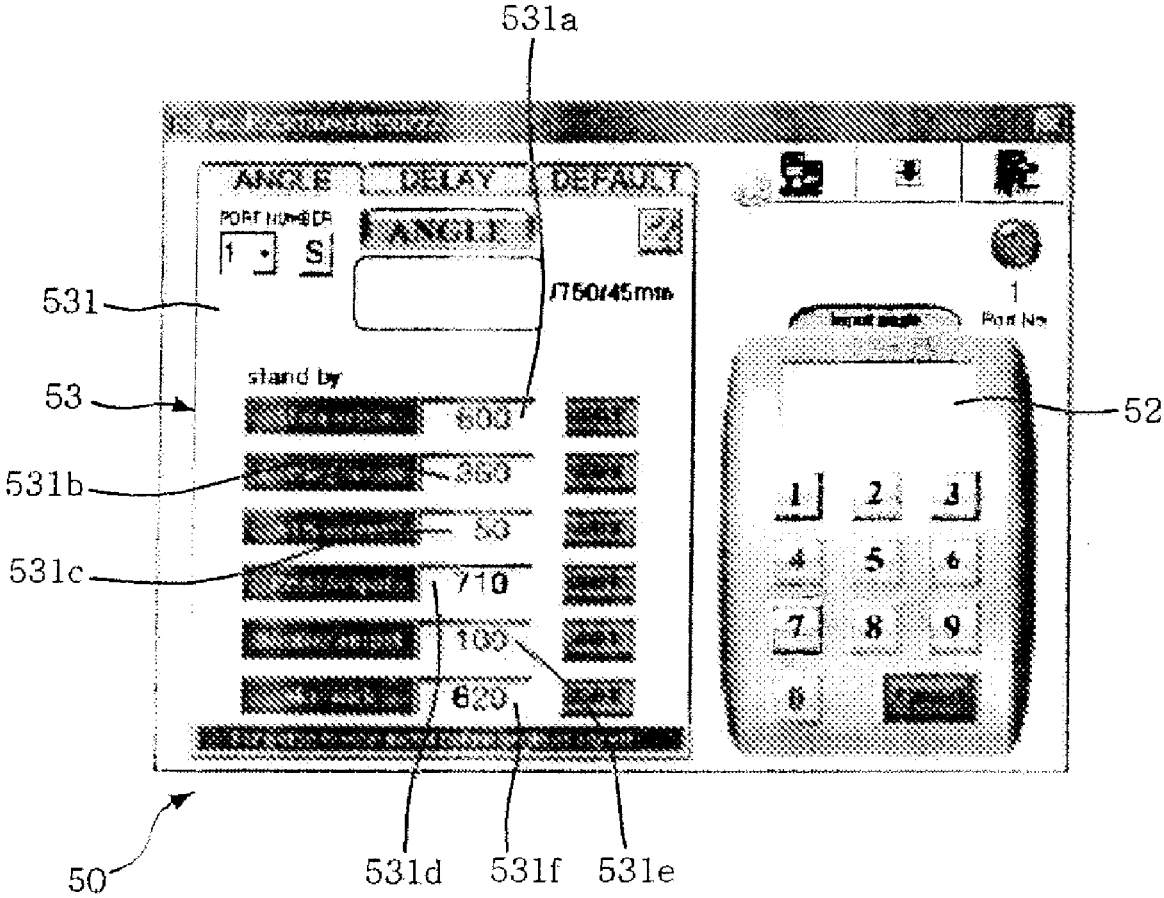
FIG. 4 is a view illustrating a driving value displaying window of the automatic medicine packaging machine according to the embodiment of the present invention.
Figure 5:
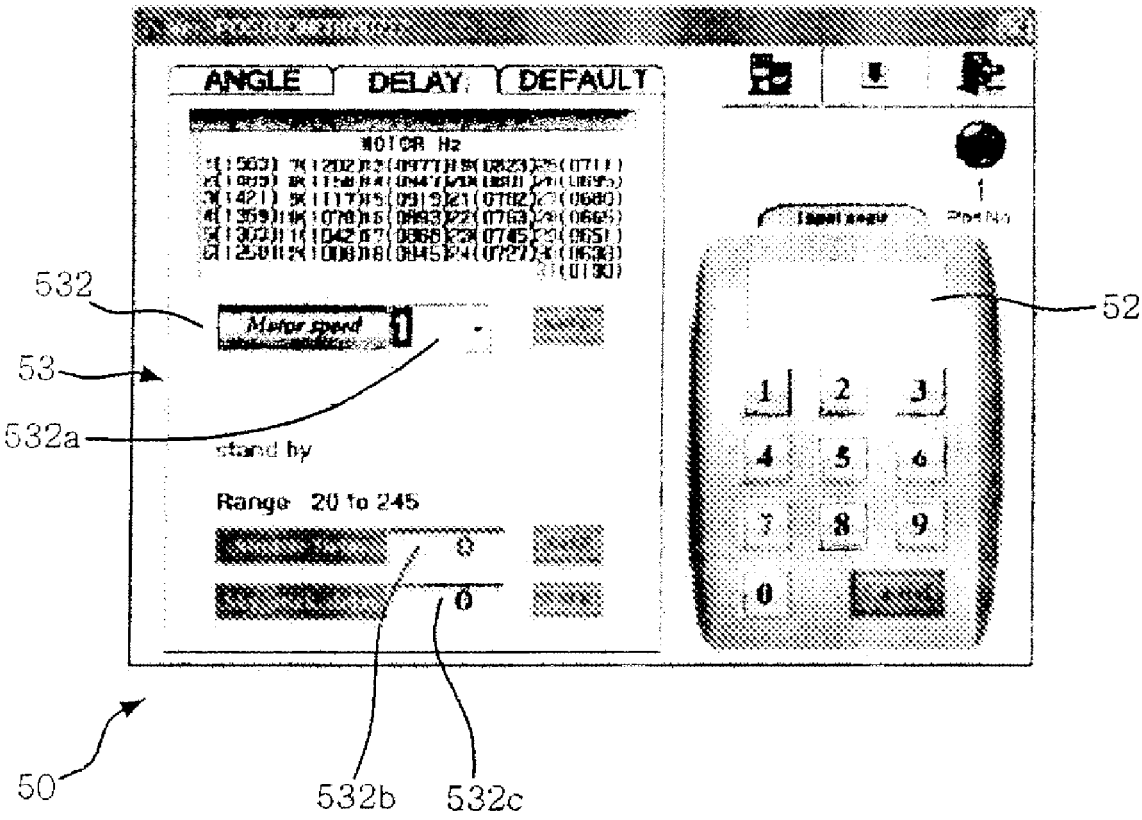
FIG. 5 is a view illustrating a delay time displaying window of the automatic medicine packaging machine according to the embodiment of the present invention.
Figure 6:
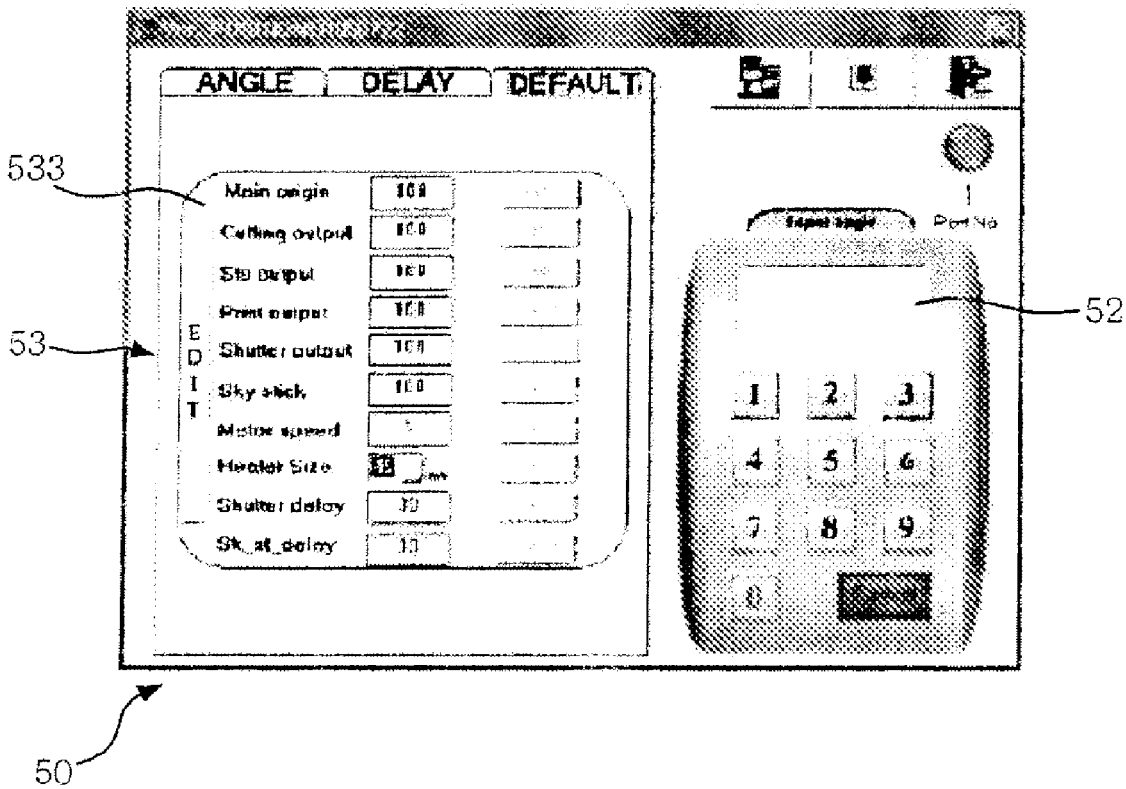
FIG. 6 is a view illustrating a batch displaying window of the automatic medicine packaging machine according to the embodiment of the present invention.
Figure 7:
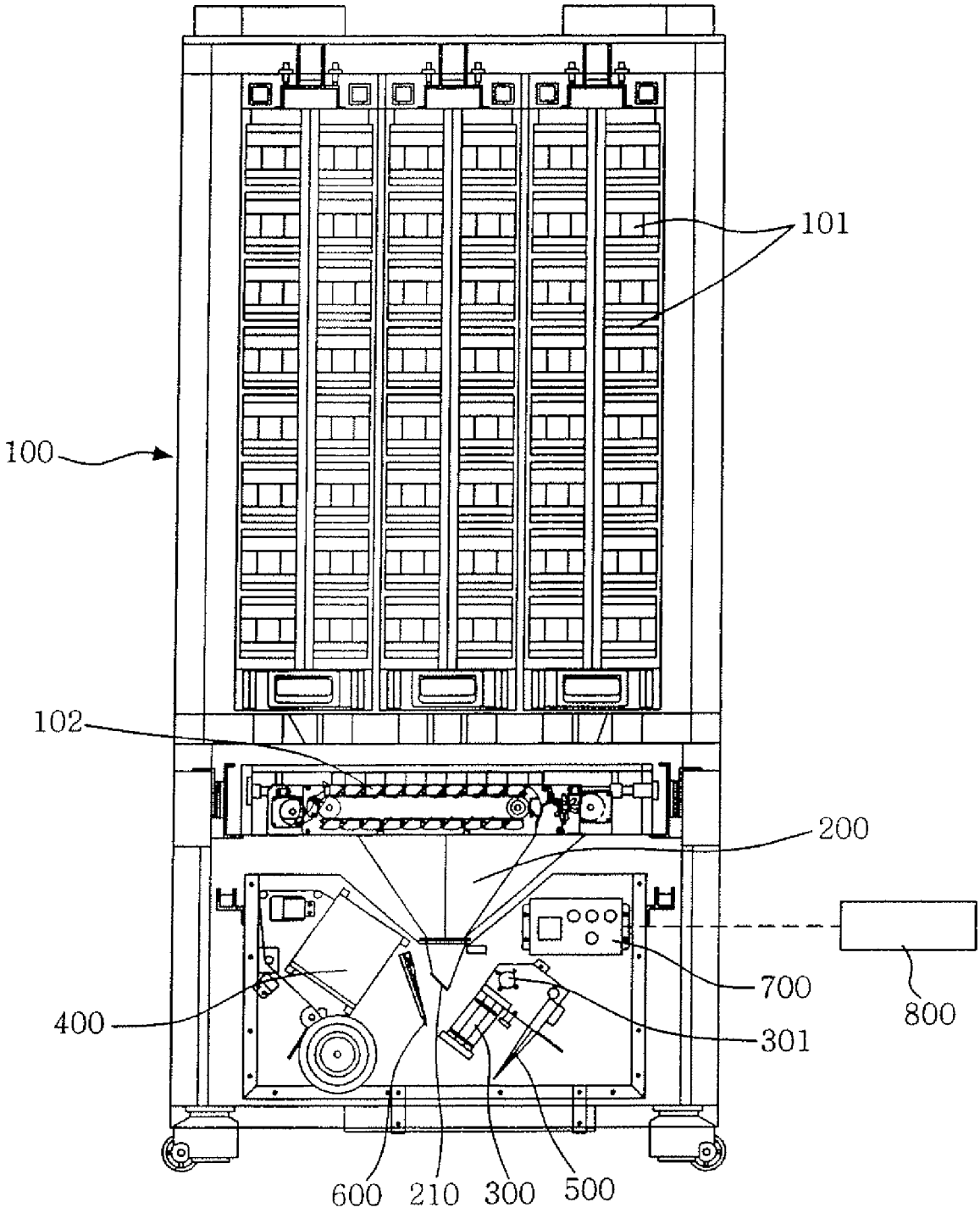
FIG. 7 is a front sectional view illustrating a conventional automatic medicine packaging machine.

FIG. 3 is a view illustrating a user authentication window of the automatic medicine packaging machine according to the embodiment of the present invention, FIG. 4 is a view illustrating a driving value displaying window of the automatic medicine packaging machine according to the embodiment of the present invention, and FIG. 5 is a view illustrating a delay time displaying window of the automatic medicine packaging machine according to the embodiment of the present invention.

As illustrated, the user interface 50 of the driving setting device includes a user authentication window 51 through which authentication information of the user for the driving setting device is inputted, a numerical value input window 52 through which the setting values are inputted as numerical values, and a setting value displaying window 53 to display the setting values inputted through the numerical value input window 52.

The user authentication window 51 is a window through which a password is inputted such that only an authenticated user uses the driving setting device, the numerical value input window 52 is a window through which numerical values for the driving values and the delay times are inputted, and the setting value displaying window 53 is a window to display the driving values and the delay times inputted by the numerical value input window 52.

The setting value displaying window 53 includes a driving value displaying window 531 to display the driving values of the respective driving devices of the automatic medicine packaging machine, a delay time displaying window 532 to display the delay time of the main motor 4*a*, and a batch displaying window 533 to display the values displayed by the driving value displaying window 531 and the delay time displaying window 533 all at once.

The driving value displaying window 531 is a window to display the driving values of the automatic medicine packaging machine when the driving values are inputted by the numerical value input window 52, the delay time displaying window 532 is a window to display the delay time of the automatic medicine packaging machine when the delay time is inputted by the numerical value input window 52, and the batch displaying window 533 displays the entire inputted driving values and delay times such that the user can easily perceive the setting values.

The driving value displaying window includes a main motor displaying window 531*a* to display a driving value of the main motor 4*a* to drive the sealer 4, a cutter displaying window 531*b* to display a driving value of the cutter 6 to cut the series of the medicine packets, in which medicines are continuously packaged by doses, by a predetermined length, a manual tray displaying window 531*c* to display a driving value of the manual dispensing tray 2*a* to discharge the tablets manually dispensed by the pharmacist, a printer displaying window 531*d* to display a driving value of the printer 5 to print the usage schedule on the medicine packaging sheets entering the sealer 4, a shutter displaying window 531*e* to display a driving value of the shutter 3*a* to open and close the lower side of the hopper 3 to collect the tablets, and a stick displaying window 531*f* to display a driving value of the hitting stick 7 to hit the doubled medicine packaging sheets to be strained.

The delay time displaying window 532 includes a motor delay displaying window 532*a* to display a delay time of the main motor 4*a* to drive the sealer 4, a shutter delay displaying window 532*b* to display a delay time of the shutter 3*a* to open and close the lower side of the hopper 3, and a stick delay displaying window 532*c* to display a delay time of the hitting stick to hit the medicine packaging sheets.

As described above, according to the present invention, the driving values and the delay times of the respective driving devices of the automatic medicine packaging machine are conveniently set and the driving values and the delay times can be also easily changed.

Moreover, the driving values and the delay times, which are completely set, are displayed such that a user easily perceives and confirms the driving values and the delay times that are completely set.

Since the driving values and the delay times set in the automatic medicine packaging machine are easily acquired even when the driving setting device is replaced, the driving values and the delay times are easily reset.

The user authentication device is provided to prevent a person other than an authenticated user from using the driving setting device.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An automatic medicine packaging machine comprising:

a medicine supply including a manual dispensing tray to supply medicines;

a hopper including a shutter disposed in a lower side of the hopper to be opened and closed;

a sealer driven by a main motor to seal medicine packaging sheets in which tablets are accommodated;

a printer to print usage schedules on the medicine packaging sheets to be fed to the sealer;

a cutter to cut the sealed medicine packaging sheets in which the tablets are accommodated;

a hitting stick to hit the medicine packaging sheets;

devices for driving the dispensing tray, the shutter, the main motor, the printer, the cutter and the hitting stick;

a main controller to control overall operation of respective driving devices of the automatic medicine packaging machine;

a storage to store data; and a driving setting device to set driving values of the respective driving devices, the driving setting device comprising:

a touch screen installed in a front side of the automatic medicine packaging machine to display a user operating program and to receive a manipulation command from a user;

a memory in which the user operation program is stored;

a communication unit to transmit and receive data to and from the main controller; and a sub-controlling unit to control overall operation of the driving setting device according to the user operating program stored in the memory and comprising an interface supplying unit to supply a user interface for a driving setting through the touch screen, a driving value setting unit to receive driving values of respective driving devices of the automatic medicine packaging machine through the touch screen and to set the driving values, a delay time setting unit to receive delay times of the main motor and the shutter through the touch screen and to set the delay times, and a setting value transmission unit to transmit the values set by the setting units to the main controller through the communication unit.

2. The automatic medicine packaging machine according to claim 1, wherein the sub-controlling unit further comprises a setting value display to display the driving values and the delay times set by the driving value setting unit and the delay time setting unit on the touch screen.

3. The automatic medicine packaging machine according to claim 2, wherein the sub-controlling unit further comprises a list transmission unit to make the setting values that are displayed by the setting value display according to the manipulation command inputted through the touch screen into a list and to transmit the list to the main controller.

4. The automatic medicine packaging machine according to claim 3, wherein the sub-controlling unit further comprises a list inquiring unit to request an inquiry for the list of the setting values to the main controller according to the manipulation commands inputted through the touch screen and to display the list of the setting values inquired by the main controller on the touch screen.

5. The automatic medicine packaging machine according to claim 4, wherein the sub-controlling unit further comprises a user authentication unit to authenticate a user for the driving setting device from authentication information inputted by the touch screen.

6. The automatic medicine packaging machine according to claim 4, wherein the user interface comprises:

a user authentication window through which authentication information of the user for the driving setting device is inputted;

a numerical value input window through which the setting values are inputted as numerical values; and a setting value displaying window to display the setting values inputted through the numerical value input window.

7. The automatic medicine packaging machine according to claim 6, wherein the setting value displaying window comprises:

a driving value displaying window to display the driving values of the respective driving devices of the automatic medicine packaging machine;

a delay time displaying window to display the delay time of the main motor; and a batch displaying window to display the values displayed by the driving value displaying window and the delay time displaying window all at once.

8. The automatic medicine packaging machine according to claim 7, wherein the driving value displaying window comprises:

a main motor displaying window to display a driving value of the main motor;

a cutter displaying window to display a driving value of the cutter;

a manual tray displaying window to display a driving value of the manual dispensing tray;

a printer displaying window to display a driving value of the printer;

a shutter displaying window to display a driving value of the shutter; and a stick displaying window to display a driving value of the hitting stick.

9. The automatic medicine packaging machine according to claim 7, wherein the delay time displaying window comprises:

a motor delay displaying window to display a delay time of the main motor;

a shutter delay displaying window to display a delay time of the shutter; and a stick delay displaying window to display a delay time of the hitting stick.

* * * * *